US008761625B2

(12) United States Patent
Miyata et al.

(10) Patent No.: US 8,761,625 B2
(45) Date of Patent: Jun. 24, 2014

(54) FIXING DEVICE, CONTROL METHOD FOR THE SAME, AND IMAGE FORMING APPARATUS

(75) Inventors: Yushi Miyata, Kanagawa (JP); Keita Maejima, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 356 days.

(21) Appl. No.: 13/204,821

(22) Filed: Aug. 8, 2011

(65) Prior Publication Data

US 2012/0051775 A1 Mar. 1, 2012

(30) Foreign Application Priority Data

Aug. 27, 2010 (JP) ..... 2010-191170

(51) Int. Cl.
*G03G 15/20* (2006.01)

(52) U.S. Cl.
USPC ..... 399/69; 399/67

(58) Field of Classification Search
USPC ..... 399/67, 69, 334; 219/600
See application file for complete search history.

(56) References Cited

FOREIGN PATENT DOCUMENTS

| | | | |
|---|---|---|---|
| JP | 2002-182526 A | | 6/2002 |
| JP | 2004-004205 A | | 1/2004 |
| JP | 2004-061650 A | | 2/2004 |
| JP | 2005-100699 A | | 4/2005 |
| JP | 2008-249948 | | 10/2008 |
| JP | 2008249948 A | * | 10/2008 |
| JP | 2009-162800 A | | 7/2009 |
| JP | 2009-204717 A | | 9/2009 |
| JP | 2009-271304 | | 11/2009 |

OTHER PUBLICATIONS

Combined Chinese Office Action and Search Report issued Nov. 27, 2013 in Patent Application No. 201110250503.0 (with English language translation).
Office Action issued Jan. 21, 2014 in Japanese Patent Application No. 2010-191170.

* cited by examiner

*Primary Examiner* — David Gray
*Assistant Examiner* — Michael Harrison
(74) *Attorney, Agent, or Firm* — Oblon, Spivak, McClelland, Maier & Neustadt, L.L.P.

(57) ABSTRACT

A fixing device includes: a heat generating rotating member including a heat generating layer; an exciting coil to inductively heat the heat generating layer; a degaussing coil generating an electrical current in response to a magnetic flux generated by the exciting coil and generating a magnetic flux in an opposite direction; an exciting coil controller configured to control energization of the exciting coil by using PWM signals; a degaussing coil controller determining necessity of switching the degaussing coil and to control energization of the degaussing coil. When the degaussing coil controller switches ON/OFF state of the degaussing coil, the exciting coil controller controls ON time periods of the PWM signals so as to be within a range from minimum to maximum values of the ON time periods of the PWM signals corresponding to the ON/OFF state of the degaussing coil stored in a storage unit.

6 Claims, 7 Drawing Sheets

FIG.4

| | ON TIME PERIOD | | OFF TIME PERIOD (NO RANGE AS FIXED) |
|---|---|---|---|
| | Max | Min | |
| DEGAUSSING COIL OFF | a1 μs | b1 μs | c1 μs |
| DEGAUSSING COIL ON | a2 μs | b2 μs | c2 μs |

WHERE a1>a2, b1>b2, AND c1>c2 ARE ASSUMED

FIG.7

| DE-GAUSSING COIL 300A | DE-GAUSSING COIL 300B | DE-GAUSSING COIL 300C | ON TIME PERIOD | | OFF TIME PERIOD (NO RANGE AS FIXED) |
|---|---|---|---|---|---|
| | | | Max | Min | |
| OFF | OFF | OFF | a1 μs | b1 μs | c1 μs |
| ON | OFF | OFF | a2 μs | b2 μs | c2 μs |
| ON | ON | OFF | a3 μs | b3 μs | c3 μs |
| ON | ON | ON | a4 μs | b4 μs | c4 μs |

WHERE a1>a2>a3>a4
b1>b2>b3>b4
c1>c2>c3>c4 IS ASSUMED

FIXING DEVICE, CONTROL METHOD FOR THE SAME, AND IMAGE FORMING APPARATUS

CROSS-REFERENCE TO RELATED APPLICATIONS

The present application claims priority to and incorporates by reference the entire contents of Japanese Patent Application No. 2010-191170 filed in Japan on Aug. 27, 2010.

BACKGROUND OF THE INVENTION

1. Field of the Invention

The present invention relates to a fixing device, a control method for the same, and an image forming apparatus.

2. Description of the Related Art

In recent years, a scanner for reading image data of a document, a copying machine for printing image data of a document read by a scanner, a printer or a facsimile machine for printing image data that has been input externally, and a so-called multi function peripheral (MFP) including some of these functions have been used. Such an MFP includes a scanning unit for reading images, an engine unit for producing toner images from each of the corresponding images read by the scanning unit on a recording medium, a fixing device (fixing system) for fixing toner images on a recording medium produced by the engine unit by using a fixing roller and a pressing roller.

A fixing device adopting an electromagnetic induction heating system includes a coil known as an exciting coil in which high frequency current flows in order to generate a magnetic flux for inductively heating a heat generating member. With this configuration, because the heat generating member is directly heated, preheating as required in a heat roller fusing system is not required and a temperature of the fixing member is instantaneously risen to a predetermined temperature. As a result, reduction of warm-up time and energy saving can be achieved. Some fixing devices adopting the electromagnetic induction heating system may include a degaussing coil generating a magnetic flux in a direction for degaussing the magnetic flux generated by the exciting coil in addition to the exciting coil.

When an induction heater (the exciting coil) and the degaussing coil are used in combination, the load imposed on the induction heater changes in response to the energization of the degaussing coil. During operation of the induction heater, switching the degaussing coil ON/OFF causes load (impedance) of the induction heater change. However, ON/OFF time periods of the PWM signals for controlling energization of the exciting coil depending on the load have not been set. In other words, minimum and maximum values of output frequencies of a high frequency power source have not been set depending on the ON/OFF state of the degaussing coil. As a result, power beyond a permissible range may be supplied to the induction heater, which may cause a failure of the induction heater.

For example, Japanese Patent Application Laid-open No. 2008-249948 discloses a fixing device for preventing excessive rising of temperature at end portions of a fixing member during passage of a small-sized paper sheet. In the fixing device, during both a time period while a degaussing coil is open and a time period while it is closed, the correlations between an output power value supplied to a resonance circuit from a high frequency power source and an output frequency of a high frequency power source corresponding to the output power value are obtained. Based on the correlations between the output power value and the output frequency f, the fixing device controls for variably setting the output frequency f of the high frequency power source so that a temperature Ta of the fixing member detected by a temperature detecting section matches a predetermined target temperature Tt. In Japanese Patent Application Laid-open No. 2008-249948, however, no method for preventing any failure of an induction heater due to load variance thereof resulting from energizing the degaussing coil is considered.

SUMMARY OF THE INVENTION

It is an object of the present invention to at least partially solve the problems in the conventional technology.

According to an aspect of the present invention, there is provided a fixing device including: a heat generating rotating member configured to include a heat generating layer; an exciting coil configured to inductively heat the heat generating layer; a degaussing coil configured to generate an electrical current in response to a magnetic flux generated by the exciting coil and to generate a magnetic flux in an opposite direction; an exciting coil controller configured to control energization of the exciting coil by using PWM signals; a degaussing coil controller configured to determine necessity of switching the degaussing coil and to control energization of the degaussing coil; and a storage unit configured to store therein data of minimum and maximum values of ON time periods of the PWM signals in relation to an ON/OFF state of the degaussing coil, wherein the data is set such that when the degaussing coil is in the ON state, the minimum and maximum values of the ON time periods of the PWM signals are set lower than those when the degaussing coil is in the OFF state, and when the degaussing coil controller switches the ON/OFF state of the degaussing coil, the exciting coil controller controls the ON time periods of the PWM signals so as to be within a range from the minimum to maximum values of the ON time periods of the PWM signals corresponding to the ON/OFF state of the degaussing coil stored in the storage unit.

According to another aspect of the present invention, there is provided a control method for a fixing device including a heat generating rotating member including a heat generating layer; an exciting coil inductively heating the heat generating layer; and a degaussing coil generating an electrical current in response to a magnetic flux generated by the exciting coil and generating a magnetic flux in an opposite direction; and a storage unit storing therein data of minimum and maximum values of ON time periods of PWM signals in relation to an ON/OFF state of the degaussing coil, wherein the data is set such that when the degaussing coil is in the ON state, the minimum and maximum values of the ON time periods of the PWM signals are set lower than those when the degaussing coil is in the OFF state, the control method including: controlling energization of the exciting coil by using the PWM signals; determining necessity of switching the degaussing coil; controlling energization of the degaussing coil; and controlling, when the ON/OFF state of the degaussing coil is switched, the ON time periods of the PWM signals so as to be within a range from the minimum to maximum values of the ON time periods of the PWM signals corresponding to the ON/OFF state of the degaussing coil stored in the storage unit.

According to still another aspect of the present invention, there is provided an image forming apparatus including a fixing device, the fixing device including: a heat generating rotating member configured to include a heat generating layer; an exciting coil configured to inductively heat the heat generating layer; a degaussing coil configured to generate an electrical current in response to a magnetic flux generated by the exciting coil and to generate a magnetic flux in an opposite direction; an exciting coil controller configured to control energization of the exciting coil by using PWM signals; a degaussing coil controller configured to determine necessity of switching the degaussing coil and to control energization of the degaussing coil; and a storage unit configured to store therein data of minimum and maximum values of ON time periods of the PWM signals in relation to an ON/OFF state of the degaussing coil, wherein the data is set such that when the degaussing coil is in the ON state, the minimum and maximum values of the ON time periods of the PWM signals are set lower than those when the degaussing coil is in the OFF state, and when the degaussing coil controller switches the ON/OFF state of the degaussing coil, the exciting coil controller controls the ON time periods of the PWM signals so as to be within a range from the minimum to maximum values of the ON time periods of the PWM signals corresponding to the ON/OFF state of the degaussing coil stored in the storage unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 4 is a table illustrating an example of data of minimum and maximum values (ranges) of ON time periods and OFF time periods of PWM signals stored in a storage unit;

FIG. 7 is a table illustrating an example of data of minimum and maximum values (ranges) of ON time periods and OFF time periods of PWM signals stored in a storage unit according to the second embodiment.

DETAILED DESCRIPTION OF THE PREFERRED EMBODIMENTS

Exemplary embodiments of a fixing device, a control method for the same, and an image forming apparatus according to the present invention are described below in detail with reference to the accompanying drawings. These embodiments, however, are not intended to limit the scope of the present invention. The elements of the following embodiments include elements that persons skilled in the art can easily assume or that are substantially the same as the elements known by those skilled in the art.

First Embodiment

Figure 1:
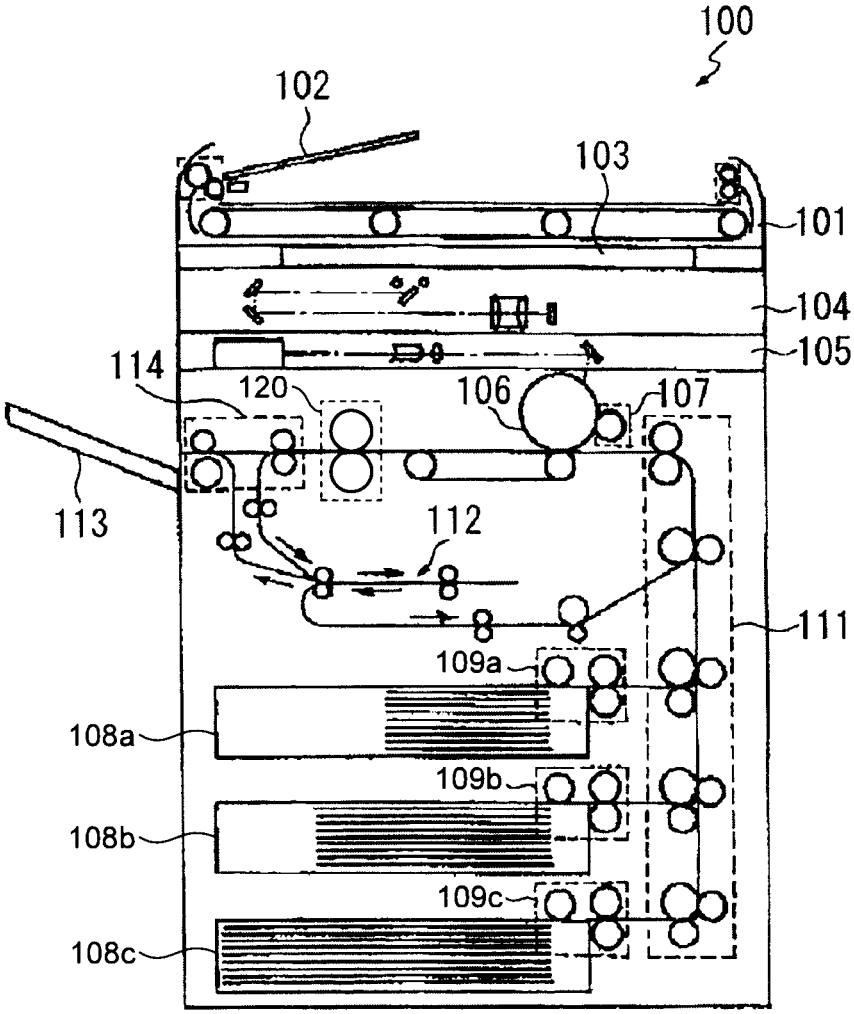
FIG. 1 is a schematic configuration diagram illustrating an example of a mechanism of an MFP according to a first embodiment.

FIG. 1 is a schematic configuration diagram illustrating an example of a mechanism of an MFP 100 according to a first embodiment. The MFP 100 is an image forming apparatus including a digital copying machine. More specifically, the MFP 100 has a copying function and other functions such as a printing function or a facsimile function. The MFP 100 has an application switching key in an operating section (not illustrated) with which the copying function, the printing function, or the facsimile function can be selected sequentially. In this way, the MFP 100 enters a copying mode when the copying function is selected, a printer mode when the printing function is selected, and a facsimile mode when the facsimile function is selected.

The MFP 100 includes a document tray (also known as a "platen") 102 provided on an automatic paper feeder (also known as an "automatic document feeder", and hereinafter referred to as an "ADF"). In the copying mode, when a Start key on the operating section (not illustrated) is pressed, sheets of a batch of originals loaded with image surfaces facing up are fed one by one from the lowest sheet of original by a feeding roller and a feeding belt sequentially to an exposure glass 103 in place to be loaded. An ADF 101 has an incremental function with which numbers of originals are incremented every time one original is fed in place. Any image on the original loaded on the exposure glass 103 is read by an image reader (also known as a "scanner" or "scanning unit") 104 and, once reading is complete, ejected by the feeding belt and a discharging roller to a discharging table.

Each time when an image of an original is read, a document detector (also known as a "document sensor") detects whether another original is on the document tray 102. If another document is on the document tray 102 by the document detector, in the same manner as described above, the lowest sheet of the document on the document tray 102 is fed by the feeding roller and the feeding belt sequentially to the exposure glass 103 in place to be loaded. Subsequent operations are the same as described above. The feeding roller, the feeding belt, and the discharging roller are driven by a carriage motor not illustrated.

A first feeding device 109*a*, a second feeding device 109*b*, or a third feeding device 109*c* feeds, when selected, a recording medium (paper sheet) respectively from a first paper feed tray 108*a*, a second paper feed tray 108*b*, or a third paper feed tray 108*c*. The recording medium is conveyed by a vertical conveying unit 111 to a position where the recording medium comes into contact with a photosensitive element 106. The photosensitive element 106 may be, for example, a photosensitive element drum driven to rotate by a main motor not illustrated.

Image data (image information) input and read from an original by the image reader 104 is image-processed in a given manner by an image processing apparatus not illustrated. Then, the image data is directly, otherwise once stored in an image memory (not illustrated) that configures a storage unit, is fed into a writing unit 105 that configures an image printing unit (printer), and converted to optical information by the writing unit 105. The surface of the photosensitive element 106 is evenly charged by a charging unit not illustrated and exposed by optical information signals emitted from the writing unit 105, whereby a static latent image is formed. The static latent image on the photosensitive element 106 will be in turn developed by a developing apparatus (also known as a "developing unit") 107 to form a toner image.

The photosensitive element 106, the charging unit, the writing unit 105, the developing unit 107, and other known devices (not illustrated) surrounding the photosensitive element 106 configure a printer engine as an image forming unit by which an image is formed from image data in electrophotography on a recording medium. A conveying belt also serves as a paper conveying unit and a transfer unit. When a transfer bias is applied from a power source, while conveying the recording medium from the vertical conveying unit 111 at the equal speed to that of the rotation of the photosensitive element 106, the conveying belt transfers the toner image from the photosensitive element 106 to the recording medium. The toner image is fixed to the recording medium by a fixing device 120, and the recording medium is ejected to a discharge tray 113 by an ejecting unit 114. The photosensitive element 106, the charging unit, the writing unit 105, the developing unit 107, the transfer unit, and the image data configure an image forming unit that produces images onto the recording medium.

In the operations as described above, an image is copied to one side of the recording medium in a normal mode. When images are copied to both sides of the recording medium in a duplex mode, operations are as follows. The recording medium fed from either one of the first paper feed tray 108*a* through the third paper feed tray 108*c* and provided with an image thereon as described above will be led to a duplex feeding sheet conveying path, not to the discharge tray 113 side, by the ejecting unit 114. After that, the recording medium is reversed in a switchback manner, and conveyed to a duplex feed unit.

The recording medium conveyed to the duplex feed unit is further conveyed to the vertical conveying unit 111 by the duplex feed unit, in turn to a position where the recording medium comes into contact with the photosensitive element 106 by the vertical conveying unit 111. The toner image on the photosensitive element 106 is transferred to the rear surface of the recording medium in the same manner as described above, then, fixed by the fixing device 120 to produce a duplex copy that will be ejected to the discharge tray 113 by the ejecting unit 114. When a recording medium is reversed to be ejected, the recording medium is reversed in a switchback manner by a reverse unit 112 and then conveyed to the discharge tray 113 through a reversed ejected sheet conveying path by the ejecting unit 114, not to the duplex feed unit.

In the printer mode, image data obtained externally is input to the writing unit 105 instead of the image data from the image processing apparatus to produce an image on a recording medium in the same manner as described above. In the facsimile mode, image data from the image reader 104 is sent to a receiver by a facsimile transmitting unit not illustrated; otherwise image data from a sender is received by the facsimile transmitting unit to be input to the writing unit 105 instead of the image data from the image processing apparatus to produce an image on a recording medium in the same manner as described above.

The MFP 100 further includes a large capacity tray (hereinafter referred to as an "LCT") not illustrated; a finisher (not illustrated) that performs processes including sorting, perforating, and stapling; and the operating section including some keys to make various settings such as modes for reading images of the original, magnification for copying, paper feeding units, finishing processes on the finisher, and displays for providing some indications to an operator, and a display monitor including an LCD.

The image reader 104 includes the exposure glass 103 on which an original is loaded, and an optical scanning system that includes an exposure lamp, a first mirror, a lens, a CCD image sensor, and other parts. The exposure lamp and the first mirror are secured on a first carriage not illustrated, while a second mirror and a third mirror are secured on a second carriage not illustrated. When an image on an original is read, the first carriage and a second carriage are mechanically moved at the relative velocity of two to one so as not to change the length of an optical path. The optical scanning system is driven by a driving unit including a scanner driving motor not illustrated.

The image reader 104 optically reads the image (image data) of the original to convert the obtained image data to electrical signals. More specifically, the image surface of the original is lit by the exposure lamp in the optical scanning system, and a reflected light image obtained from the image surface is formed on a light-receptive surface of the CCD image sensor via the first mirror, the second mirror, the third mirror, and the lens, then converted to electrical signals by the CCD image sensor. During this process, a magnification for reading images in a document feeding direction can be changed by moving the lens and the CCD image sensor in a lateral direction in FIG. 1. That is, positions of the lens and the CCD image sensor in the lateral direction are determined according to predetermined magnifications for reading images.

The writing unit 105 includes a laser output unit, an imaging lens, a mirror, and other parts. The laser output unit incorporates a laser diode that is a source of laser light, and a polygon mirror (a rotating multifaceted mirror) rotating at constant high velocity by a motor. A laser beam (laser light) emitted from the laser output unit is deflected by the polygon mirror rotating at constant velocity, passes through the imaging lens, is turned back on the mirrors, and converge to form an image on the charged surface of the photosensitive element 106.

More specifically, the laser beam deflected by the polygon mirror is used for expose scanning in a direction orthogonal to a direction in which the photosensitive element 106 rotates (main-scanning direction), thereby writing the image data output from the image processing apparatus on a line basis. By repeating the main scanning at a given cycle corresponding to a rotational speed of the photosensitive element 106 and a scanning density (recording density), a static latent image is formed on the charged surface of the photosensitive element 106.

Figure 2A:
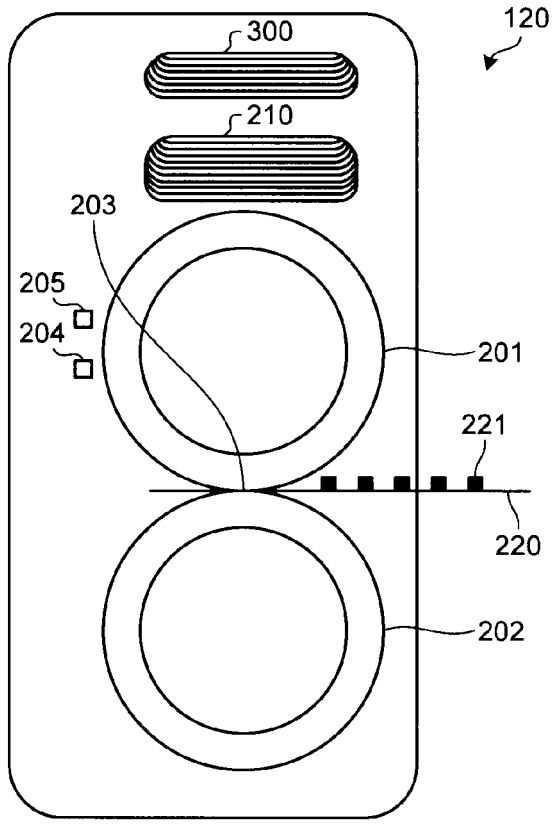
FIG. 2A is a schematic front view illustrating an example of a configuration of a fixing device illustrated in FIG. 1.
Figure 2B:
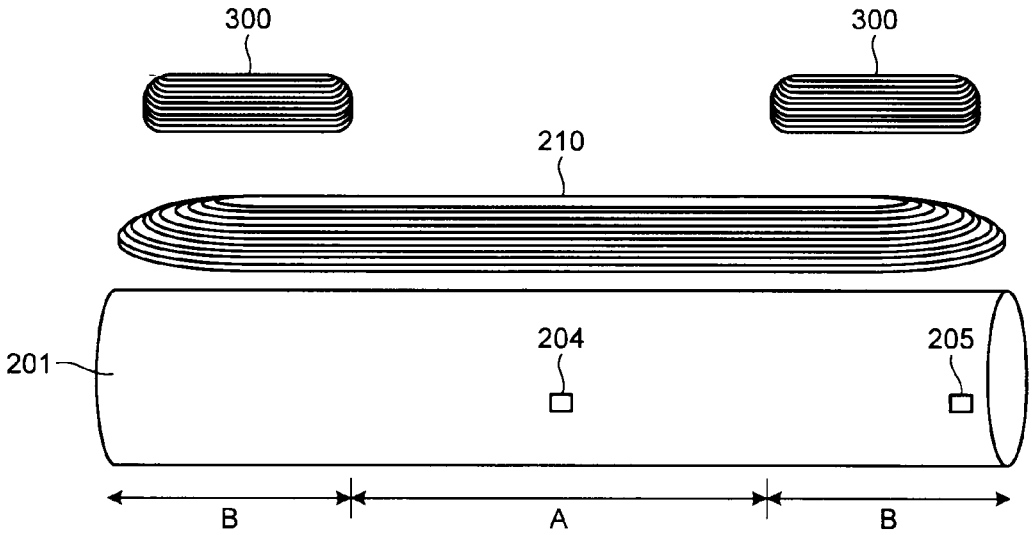
FIG. 2B is a schematic side view illustrating an exciting coil and a pair of degaussing coils of the fixing device illustrated in FIG. 1.

A configuration of the fixing device 120 illustrated in FIG. 1 will now be described with reference to FIG. 2A and FIG. 2B. FIG. 2A is a schematic front view illustrating an example of a configuration of the fixing device 120 illustrated in FIG. 1, and FIG. 2B is a schematic side view illustrating an exciting coil and a pair of degaussing coils of the fixing device 120 illustrated in FIG. 1.

The fixing device 120 adopts an electromagnetic induction heating system and includes, as illustrated in FIG. 2A, a fixing roller 201 that is a heat generating rotating member having a heat generating layer; a pressing roller 202; an exciting coil 210 inductively heating the heat generating layer of the fixing roller 201; a pair of degaussing coils 300 generating an electrical current in response to the magnetic flux generated by the exciting coil 210 and generating a magnetic flux in an opposite direction; a first temperature sensor 204; and a second temperature sensor 205. The fixing roller 201 and the pressing roller 202 are pressingly contacted with each other by a spring or other biasing force units (not illustrated) so as to form a nip 203 through which a recording medium 220 passes.

The fixing roller 201 includes, for example, a cylindrical mandrel provided innermost and made of a metal, more specifically stainless used steel (SUS); an elastic member as an elastic layer made of an heat-resistant silicone rubber in a solid state or a foaming state, in other words, in a sponge state to function as a heat insulation layer to cover the mandrel; and a fixing sleeve provided on the outside of the elastic member as a heat generating rotating member.

The pressing roller 202 is rotated by a driving source not illustrated in a counterclockwise direction, whereby the fixing roller 201 is rotated in a clockwise direction. In a fixing operation, the recording medium 220 to which toner 221 adheres is conveyed from the right side to the left side through the nip 203, whereby the toner 221 is fixed to the recording medium 220. The operation may be such that the fixing roller 201 is driven to be rotated whereby the pressing roller 202 is rotated accordingly. The relationship of driving and driven between the fixing roller 201 and the pressing roller 202 may be reversed.

The exciting coil 210 is provided, as illustrated in FIG. 2B, above the fixing roller 201 narrowly in an axial direction thereof, for example. More specifically, the exciting coil 210 is wound several times to form a bundled conductor layer in an ellipse shape. The conductor layer is supported by a holder not illustrated and provided close to the outer circumferential surface of the fixing roller 201. In this way, by applying an alternating current to the exciting coil 210, the heat generating layer included in the fixing roller 201 is directly heated by induction heating.

The first temperature sensor 204 functioning as a middle temperature detecting unit is provided opposed to a middle portion A with respect to the axial direction on the outer circumferential surface of the fixing roller 201 so as to detect the surface temperature Tc of the middle portion A of the fixing roller 201 by using a known infrared system. The temperature Tc detected by the first temperature sensor 204 is transmitted to the fixing control unit (see FIG. 3).

The second temperature sensor 205 functioning as an end portion temperature detecting unit is provided opposed to end portions B with respect to the axial direction on the outer circumferential surface of the fixing roller 201 so as to detect the surface temperature Te of the end portions of the fixing roller 201 by using a known infrared system. The temperature Te detected by the second temperature sensor 205 is transmitted to the fixing control unit (see FIG. 3).

The pair of degaussing coils 300 is positioned to be secured. Each of the degaussing coils 300 is provided above and along the exciting coil 210 in an area corresponding to the end portions B on both sides of the fixing roller 201 with respect to the axial direction.

The exciting coil 210 applies induction heating to the heat generating layer included in the fixing roller 201 according to the control of the fixing control unit. The pair of degaussing coils 300 opens or closes by being switched OFF or ON depending on degaussing coil switching signals from the fixing control unit. When the pair of degaussing coils 300 is in a "open" state (i.e., "OFF state"), because no induced current is applied to the pair of degaussing coils 300, no degaussing occurs. When the pair of degaussing coils 300 is in a "closed" state (i.e., "ON state"), induced current is applied to the degaussing coils 300, so that degaussing is available.

When the degaussing coils 300 are "open", the degaussing coils 300 do not generate the degaussing force, whereby the power applied to the end portions B of the fixing roller 201 becomes substantially equal to the power applied to the middle portion A thereof. In this case, favorable fixing is available for a maximum-sized sheet of the recording medium passing through almost the entire area of the fixing roller 201 in the axial direction. On the other hand, when the degaussing coils 300 are "closed", the degaussing coils 300 generate degaussing force, accordingly the power applied to the end portions B of the fixing roller 201 is smaller than the power applied to the middle portion A thereof. As a result, excessive rising of temperature at the end portion B of the fixing roller 201 can be prevented even when the size of the sheet of the recording medium 220 is so small as to pass through only the middle portion A of the fixing roller 201. Therefore, favorable fixing is available for a small-sized paper sheet. The degaussing coils 300 are switched ON or OFF depending on paper sizes (for example, the degaussing coils 300 are switched "ON" for a small-sized paper sheet, and switched "OFF" for a large-sized paper sheet).

Figure 3:
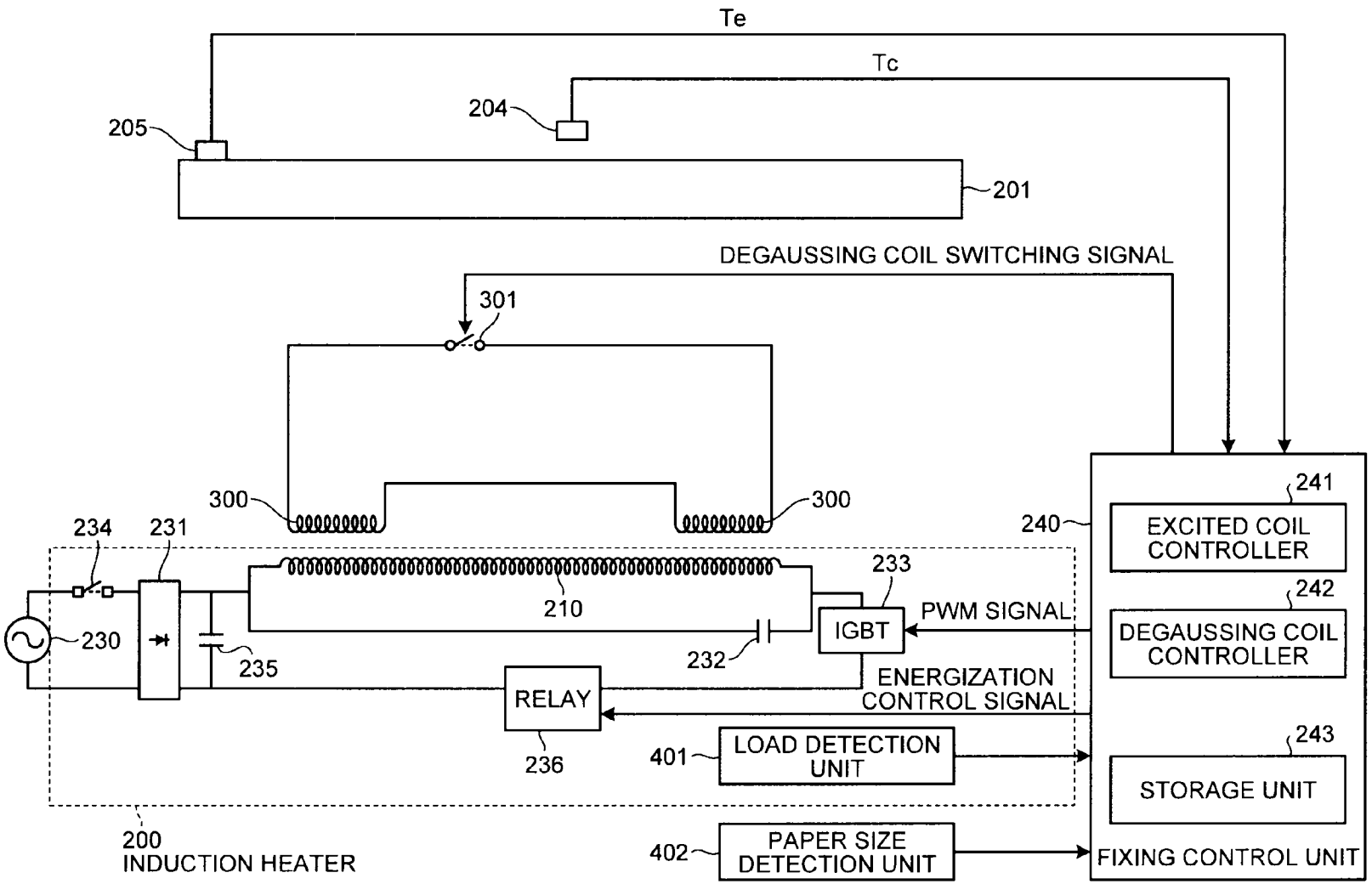
FIG. 3 is a schematic diagram illustrating an example of a hardware configuration of the fixing device.

FIG. 3 is a schematic view illustrating an example of a hardware configuration of the fixing device 120. The fixing device 120 mainly includes a fixing control unit 240 mounted on a control board, an induction heater 200, and the degaussing coils 300.

The induction heater 200 mainly includes the exciting coil 210, a resonant capacitor 232, a power switch 234, a rectifier diode 231, a smoothing capacitor 235, an IGBT 233, a relay 236, and a load detection unit 401.

The first temperature sensor 204 is mainly used to control for applying power to the exciting coil 210. The second temperature sensor 205 is mainly used to control for applying power to the degaussing coils 300. The middle temperature Tc and the end portion temperature Te respectively detected by the first temperature sensor 204 and the second temperature sensor 205 are input to the fixing control unit 240. In the fixing control unit 240, feedback control for controlling the temperature of the fixing roller 201 is performed so that it reaches a predetermined reference temperature such as a fixing targeted temperature.

When the power switch 234 is ON, current from a commercial power supply 230 is smoothed by the rectifier diode 231 and the smoothing capacitor 235 to be supplied to the exciting coil 210 through the relay 236 and the IGBT 233.

When the power switch 234 is ON, the relay 236 is switched ON, which can in turn shut off the induction heater 200 through the fixing control unit 240. More specifically, the fixing control unit 240 can switch the relay 236 ON or OFF by using energization control signals to energize or shut off the induction heater 200.

A paper size detection unit 402 detects the size of a paper sheet passing through, and outputs the obtained value of the size to the fixing control unit 240. The load detection unit 401 detects the load imposed on the induction heater 200 and outputs the obtained value of the load to the fixing control unit 240.

The fixing control unit 240 is provided on the control board to control the fixing device 120 on the whole. The fixing control unit 240 controls ON/OFF of, for example, the relay 236, the IGBT 233, and the degaussing coils 300, thereby controlling ON/OFF and the temperature of the fixing roller 201. The fixing control unit 240 is mounted as a computer in which a CPU, a RAM, a ROM, an NVRAM, an application specific integrated circuit (ASIC), and an input-output interface (not illustrated) are coupled with each other through buses. The fixing control unit 240 functions as an exciting coil controller 241, a degaussing coil controller 242, and a storage unit 243.

The exciting coil controller 241 controls the IGBT 233 that is a switching element by using Pulse Width Modulation (PWM) control, thereby controlling energization of the exciting coil 210. When no sheet of paper passes through, the exciting coil controller 241 controls the temperature of the middle portion of the fixing roller 201 so as to reach the predetermined temperature based on the middle temperature Tc. The exciting coil controller 241 controls the energization of exciting coil 210 by using PWM signals switching the IGBT 233. When a ON/OFF state of the degaussing coils 300 is switched, the ON time periods of PWM signals are controlled to be within a range from the minimum to maximum values of the ON time periods of PWM signals corresponding to the switching state of the degaussing coils 300 stored in the storage 243. The exciting coil controller 241 switches the relay 236 ON or OFF by using energization control signals, thereby switching ON/OFF of the induction heater 200 (exciting coil 210). For example, if the value of the load imposed on the induction heater 200 received from the load detection unit 401 is beyond the predetermined range, the induction heater 200 will be shut off.

The degaussing coil controller 242 selectively closes a switch 301 based on the end portion temperature Te and/or the size of a paper sheet passing through, thereby controlling the energization of the degaussing coils 300. Accordingly, the amount of heat generation of the fixing roller 201 in an area where no paper passes through can be reduced. A detecting unit determining whether the degaussing coils 300 are properly switched may be provided.

The storage 243 stores therein the data of minimum and maximum values of the ON/OFF time periods of PWM signals in relation to the ON/OFF state of the degaussing coils 300. FIG. 4 is a table illustrating an example of data of minimum and maximum values (ranges) ON time periods and OFF time periods of the PWM signals stored in the storage unit 243.

As described above, when the exciting coil 210 and the degaussing coils 300 are used in combination, the load imposed on the induction heater 200 changes depending on the ON/OFF state of the degaussing coils 300. When the load imposed on the induction heater 200 changes, input power varies if the ON time periods of the PWM signals are fixed. Accordingly, the induction heater 200 may break down if the power is beyond a permissible range. Therefore, in order to keep the input power constant regardless of the load, the ON time periods of the PWM signal need to be changed. According to the present embodiment, a failure of the induction heater 200 can be prevent by setting an ON time periods of the PWM with which constant power is input even when the load imposed on the induction heater 200 changes during operation.

When the ON/OFF state of the degaussing coils 300 is changed from OFF to ON, a resonance frequency of the exciting coil 210 that influences on the minimum and maximum values of the ON/OFF time periods of the PWM signals becomes higher. Therefore, the minimum and maximum values of the ON time periods of the PWM signals are set to be lowered when the resonance frequency becomes higher.

As illustrated in FIG. 4, the minimum and maximum values (ranges) of the ON time periods and the OFF time periods (fixed values) of PWM signals are registered in relation to the ON/OFF state of the degaussing coils 300. According to an example in FIG. 4, the following values are registered as ON/OFF time periods of the PWM signals: while the degaussing coils 300 are in the OFF state, the maximum value of the ON time period=a1 μs, the minimum value of the ON time period=b1 μs, OFF time period=c1 μs; while the degaussing coils 300 are in the ON state, the maximum value of the ON time period=a2 μs, the minimum value of the ON time period=b2 μs, OFF time period=c2 μs. Where, a1>a2, b1>b2, c1>c2 are assumed.

Figure 5:
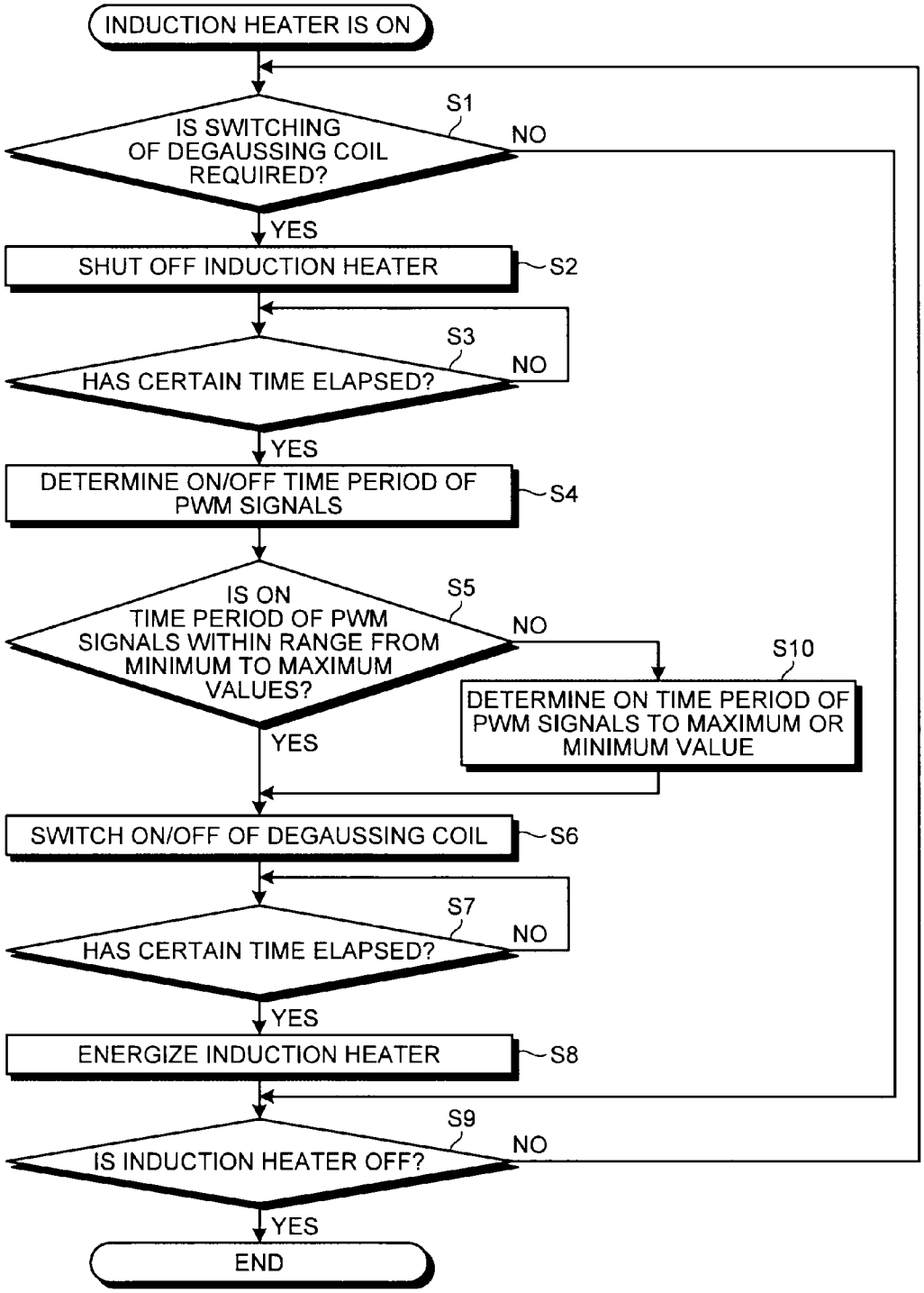
FIG. 5 is a flowchart for explaining an example of control of a fixing control unit.

FIG. 5 is a flowchart for explaining an example of control of the fixing control unit 240.

With reference to FIG. 5, when the induction heater 200 is switched ON, the degaussing coil controller 242 determines whether the degaussing coils 300 need to be switched based on the size of paper sheet passing through and the end portion temperature Te (step S1). According to the present embodiment, although necessity of switching the degaussing coils 300 is determined based on the end portion temperature Te and the size of paper sheet passing through, at least one of either the end portion temperature Te or the size of paper sheet passing through may be used for the determination. When the degaussing coil controller 242 determines that the pair of degaussing coils 300 is need to be switched ("Yes" at step S1), the exciting coil controller 241 switches the relay 236 OFF to shut off the induction heater 200 (step S2).

After the induction heater 200 is shut off, the exciting coil controller 241 counts a certain time period. If the certain time period has elapsed ("Yes" at step S3), the exciting coil controller 241 determines the ON and OFF time periods of the PWM signal based on the middle temperature Tc (step S4). The exciting coil controller 241 counts the certain time period as described above to prevent applying current at the time of switching the relay.

The exciting coil controller 241, then, reads out the minimum and maximum ON time periods and OFF time period of PWM signal corresponding to the ON/OFF state of the degaussing coils 300 after being switched from the storage unit 243. The exciting coil controller 241 determines whether the ON time period determined at step S4 is within the range from the minimum to maximum values of the ON time periods read out, and whether the OFF time period determined at step S4 matches the OFF time period read out (step S5).

More specifically, the following values are read out from the storage unit 243 for the PWM signals: when the degaussing coils 300 are switched OFF, the maximum value of the ON time period=a1 μs, the minimum value of the ON time period=b1 μs, OFF time period=c1 μs; when the degaussing coils 300 are switched ON, the maximum value of the ON time period=a2 μs, the minimum value of the ON time period=b2 μs, OFF time period=c2 μs.

If the value of the ON time period determined in step S4 is within the range from the minimum to maximum values of the ON time periods read out, and the OFF time period determined in step S4 matches the OFF time period read out ("Yes" at step S5), the exciting coil controller 241 moves to step S6.

If the ON time period determined in step S4 is beyond the range from the minimum to maximum values of the ON time periods read out, or the OFF time period determined in step S4 does not match the OFF time period read out ("No" at step S5), the exciting coil controller 241 changes the PWM values as follows: the value lower than the minimum value of the ON time period to the minimum value, the value higher than the maximum value of the ON time period to the maximum value, or the value of the OFF time period different from the OFF time period read out to the value of the OFF time period read out (step S10). Then, the exciting coil controller 241 moves to step S6.

In step S6, the degaussing coil controller 242 switches the switch 301 ON and OFF, thereby switching the ON/OFF state of the degaussing coils 300. After that, the exciting coil controller 241 counts a certain time period. If the certain time period has elapsed ("Yes" at step S7), the exciting coil controller 241 starts energizing and controls the induction heater 200 by using the values of the ON/OFF time period of the PWM signal determined at step S4 or S5 (step S8). The exciting coil controller 241 counts the certain time period as described above to prevent applying current at the time of switching the relay.

If the induction heater 200 is not in OFF ("No" at step S9), the exciting coil controller 241 returns to step S1 to repeat the steps as described above until the induction heater 200 is switched OFF. As a result, the minimum and maximum values of the ON/OFF time periods of the PWM signals can be set each time when the ON/OFF state of the degaussing coils 300 is changed a plurality of times while the induction heater 200 is in operation.

As described above, according to the first embodiment, the fixing device 120 includes: the fixing roller 201 having the heat generating layer; the exciting coil 210 inductively heating the heat generating layer; the degaussing coils 300 generating a magnetic flux in a direction opposite to a direction of the magnetic flux generated by the exciting coil 210; the exciting coil controller 241 controlling the energization of exciting coil 210 by using PWM signals; the degaussing coil controller 242 determining necessity of switching the degaussing coils 300 and controlling energization thereof; and the storage unit 243 storing therein data of the minimum and maximum values of the ON time periods of PWM signals in relation to the ON/OFF state of the degaussing coils 300. The data is set such that if the degaussing coils 300 are in the ON state, the minimum and maximum values of the ON time periods of PWM signals are set lower than those when the degaussing coils 300 are in the OFF state. When the degaussing coil controller 242 switches the ON/OFF state of the degaussing coils 300, the exciting coil controller 241 controls the ON time periods of PWM signals so as to be within the range from the minimum to maximum values of the ON time periods of PWM signals in relation to the switching state of the degaussing coils 300 stored in the storage 243. Accordingly, in the fixing device adopting the electromagnetic induction heating system, the abnormal power output of the fixing device due to load variance resulting from switching the degaussing coils ON/OFF can be prevented, whereby a failure of the fixing device can be prevented.

The degaussing coil controller 242 determines necessity of switching the degaussing coils 300 based on the end portion temperature Te of the fixing roller 201 and/or the size of paper sheet passing through, making it possible to switch the degaussing coils 300 based on the end portion temperature Te of the fixing roller 201 and/or the size of paper sheet passing through.

The exciting coil controller 241 shut off the exciting coil 210 temporarily primarily if the degaussing coil controller 242 determines that the degaussing coils 300 needs to be switched. Therefore, safety while the degaussing coils 300 are switched can be ensured.

After the exciting coil controller 241 shuts off the exciting coil 210, the degaussing coil controller 242 switches the ON/OFF state of the degaussing coils 300. After that, when a certain time has elapsed the exciting coil controller 241 energizes the exciting coil 210. Therefore, safety while the degaussing coils 300 are switched can be further ensured.

Second Embodiment

Figure 6:
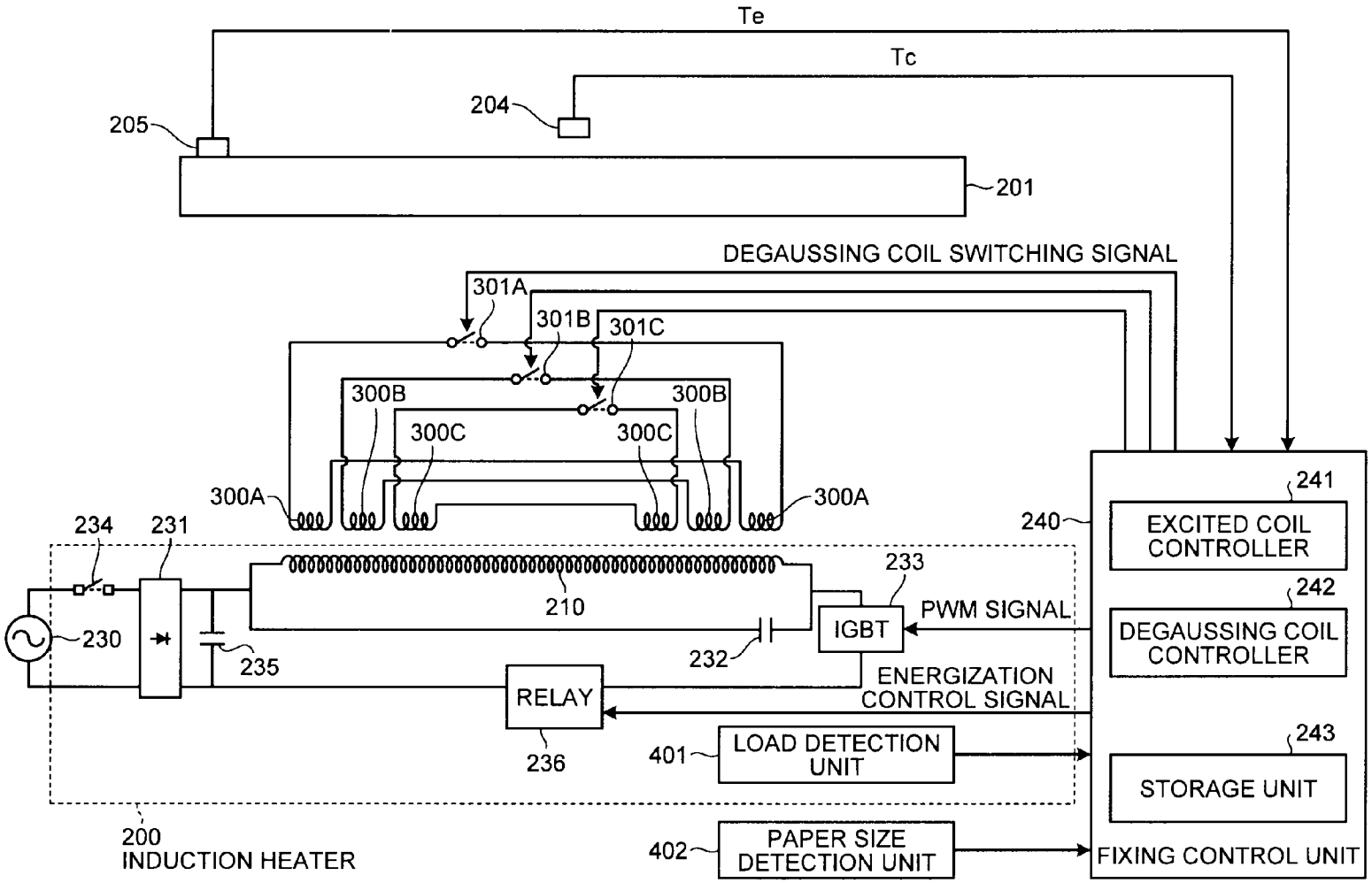
FIG. 6 is a schematic diagram illustrating an example of a hardware configuration of a fixing device according to a second embodiment.

In the first embodiment, the configuration including the pair of degaussing coils 300 is described, however, a plurality of pairs of degaussing coils may be used. In this case, the minimum and maximum values of the ON time periods and the OFF time periods of the PWM signals may be set depending on combinations of ON/OFF of the pairs of degaussing coils. FIG. 6 is a schematic diagram illustrating an example of a hardware configuration of the fixing device according to a second embodiment. FIG. 7 is a table illustrating an example of data of the minimum and maximum values (ranges) of ON time periods and OFF time periods of PWM signals stored in a storage unit 243 according to the second embodiment. With reference to FIGS. 6 and 7, only different points from the first embodiment are described while other configurations are the same as described.

As illustrated in FIG. 6, pairs of degaussing coils 300A, 300B, and 300C are provided in order from the end portion sides of the fixing roller 201. The exciting coil controller 241 switches 301A, 301B, and 301C ON or OFF based on an end portion temperature Te and/or the size of paper sheet passing through, whereby the degaussing coils 300A, 300B, and 300C can be switched ON or OFF.

As illustrated in FIG. 7, the minimum and maximum values (ranges) of the ON time periods and the OFF time periods (fixed values) of PWM signals are registered in relation to the ON/OFF state of the degaussing coils 300. According to an example in FIG. 7, the following values are registered as ON/OFF time periods of the PWM signals: while the degaussing coils 300A are in the OFF state, the degaussing coils 300B are in the OFF state, and the degaussing coils 300C are in the OFF state, the maximum value of the ON time period=a1 μs, the minimum value of the ON time period=b1 μs, OFF time period=c1 μs; while the degaussing coils 300A are in the ON state, the degaussing coils 300B are in the OFF state, and the degaussing coils 300C are in the OFF state, the maximum value of the ON time period=a2 μs, the minimum value of the ON time period=b2 μs, OFF time period=c2; while the degaussing coils 300A are in the ON state, the degaussing coils 300B are in the ON state, and the degaussing coils 300C are in the OFF state, the maximum value of the ON time period=a3 μs, the minimum value of the ON time period=b3 μs, OFF time period=c3; while the degaussing coils 300A are in the ON state, the degaussing coils 300B are in the ON state, and the degaussing coils 300C are in the ON state, the maximum value of the ON time period=a4 μs, the minimum value of the ON time period=b4 μs, OFF time period=c4; where a1>a2>a3>a4, b1>b2>b3>b4, c1>c2>c3>c4 are assumed.

The electromagnetic induction heating system adopted by the fixing device is not limited to an external heating system. An internal heating system including one or more exciting coils in the fixing roller 201, for example, may be adopted instead. A heating system in which the fixing roller is heated by using a fixing belt may be adopted instead of a heating system in which the fixing roller is directly heated.

The image forming apparatuses according to the first and second embodiments have a hardware configuration utilizing a typical computer that includes a controller such as a CPU, a storage device such as a ROM or a RAM, an HDD, and an external storage device such as a CD drive.

A computer program executed on the image forming apparatuses according to the first and second embodiments is written in a computer-readable recording medium such as a CD-ROM, a flexible disk (FD), a CD-R, or a digital versatile disk (DVD), in an installable format file or an executable format file to be provided to users.

Another configuration may store therein a computer program executed on the image forming apparatuses according to the first and second embodiments on a computer coupled with a network including the Internet such that users download the program via the networks. Another configuration may provide or distribute a computer program controlling a heater executed on the image forming apparatuses according to the first and second embodiments via a network including the Internet.

The computer program according to the first and second embodiments may be installed in a ROM or the like in advance.

The computer program executed on the image forming apparatuses according to the first and second embodiments has a module configuration including the exciting coil controller and the degaussing coil controller described above. In terms of a hardware configuration in practice, a CPU (processer) reads out to execute the program controlling a heater from the storage medium, whereby the units described above are loaded and generated into a main memory.

In the first embodiment and the second embodiment, the image forming apparatuses may be an MFP having two or more functions of copying, printing, scanning, and facsimile. Therefore, the first embodiment and the second embodiment can be applied to any one of a copying machine, a printer, a scanner, a facsimile machine, and other image forming apparatuses.

According to some aspects of the present invention, in the fixing device adopting the electromagnetic induction heating system, the failure of the fixing device due to load variance resulting from switching the degaussing coils ON/OFF can be effectively prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a heat generating rotating member configured to include a heat generating layer;

an exciting coil configured to inductively heat the heat generating layer;

a degaussing coil configured to generate an electrical current in response to a magnetic flux generated by the exciting coil and to generate a magnetic flux in an opposite direction;

an exciting coil controller configured to control energization of the exciting coil by using PWM signals;

a degaussing coil controller configured to determine a necessity of switching the degaussing coil and to control energization of the degaussing coil; and a storage unit configured to store therein data of fixed values of OFF time periods of the PWM signals and minimum values of ON time periods of the PWM signals in relation to an ON/OFF state of the degaussing coil, the minimum values being set so as to prevent a failure of the fixing device, wherein the data is set such that when the degaussing coil is in the ON state, the fixed values of OFF time periods of the PWM signals and the minimum values of the ON time periods of the PWM signals are set lower than the fixed values and the minimum values when the degaussing coil is in the OFF state, and when the degaussing coil controller switches the ON/OFF state of the degaussing coil, the exciting coil controller uses the fixed value of the OFF time periods of the PWM signals corresponding to the ON/OFF state of the degaussing coil stored in the storage unit, and uses the minimum values of the ON time periods of the PWM signals corresponding to the ON/OFF state of the degaussing coil stored in the storage unit, when a value of the ON time periods of the PWM signals is lower than the minimum values of the ON time periods of the PWM signals.

2. The fixing device according to claim 1, wherein the degaussing coil controller determines the necessity of switching the degaussing coil based on any one of a temperature of an end portion of the heat generating rotating member and a size of a paper sheet passing through or both.

3. The fixing device according to claim 1, wherein when the degaussing coil controller determines that the degaussing coil needs to be switched, the degaussing coil controller shuts off the exciting coil.

4. The fixing device according to claim 3, wherein after the exciting coil controller shuts off the exciting coil, the degaussing coil controller switches the ON/OFF state of the degaussing coil, and when a certain time period has elapsed after the ON/OFF state of the degaussing coil is switched, the exciting coil controller energizes the exciting coil.

5. A control method for a fixing device including a heat generating rotating member including a heat generating layer; an exciting coil inductively heating the heat generating layer; a degaussing coil generating an electrical current in response to a magnetic flux generated by the exciting coil and generating a magnetic flux in an opposite direction; and a storage unit storing therein data of fixed values of OFF time periods of the PWM signals and minimum and of ON time periods of PWM signals in relation to an ON/OFF state of the degaussing coil, the minimum values being set so as to prevent a failure of the fixing device, wherein the data is set such that when the degaussing coil is in the ON state, the fixed values of OFF time periods of the PWM signals and the minimum values of the ON time periods of the PWM signals are set lower than the fixed values and the minimum values when the degaussing coil is in the OFF state, the control method comprising:

controlling energization of the exciting coil by using the PWM signals;

determining a necessity of switching the degaussing coil;

controlling energization of the degaussing coil; and when the degaussing coil controller switches the ON/OFF state of the degaussing coil, the exciting coil controller uses the fixed value of the OFF time periods of the PWM signals corresponding to the ON/OFF state of the degaussing coil stored in the storage unit, and uses the minimum values of the ON time periods of the PWM signals corresponding to the ON/OFF state of the degaussing coil stored in the storage unit, when a value of the ON time periods of the PWM signals is lower than the minimum values of the ON time periods of the PWM signals.

6. An image forming apparatus comprising:

a fixing device, the fixing device including:

a heat generating rotating member configured to include a heat generating layer;

an exciting coil configured to inductively heat the heat generating layer;

a degaussing coil configured to generate an electrical current in response to a magnetic flux generated by the exciting coil and to generate a magnetic flux in an opposite direction;

an exciting coil controller configured to control energization of the exciting coil by using PWM signals;

a degaussing coil controller configured to determine a necessity of switching the degaussing coil and to control energization of the degaussing coil; and a storage unit configured to store therein data of fixed values of OFF time periods of the PWM signals and minimum values of ON time periods of the PWM signals in relation to an ON/OFF state of the degaussing coil, the minimum values being set so as to prevent a failure of the fixing device, wherein the data is set such that when the degaussing coil is in the ON state, the fixed values of OFF time periods of the PWM signals and the minimum values of the ON time periods of the PWM signals are set lower than the fixed values and the minimum values when the degaussing coil is in the OFF state, and when the degaussing coil controller switches the ON/OFF state of the degaussing coil, the exciting coil controller uses the fixed value of the OFF time periods of the PWM signals corresponding to the ON/OFF state of the degaussing coil stored in the storage unit, and uses the minimum values of the ON time periods of the PWM signals corresponding to the ON/OFF state of the degaussing coil stored in the storage unit, when a value of the ON time periods of the PWM signals is lower than the minimum values of the ON time periods of the PWM signals.

* * * * *